US006155324A

United States Patent [19]

Elliott et al.

[11] Patent Number: 6,155,324

[45] Date of Patent: Dec. 5, 2000

[54] APPARATUS AND METHOD FOR OPERATING A DOOR

[75] Inventors: Edward John Elliott, Mesa; Richard Gordon Cookson, Phoenix, both of Ariz.

[73] Assignee: The Cookson Company, Phoenix, Ariz.

[21] Appl. No.: 09/280,442

[22] Filed: Mar. 29, 1999

[51] Int. Cl.[7] ..... E05F 15/20

[52] U.S. Cl. ..... 160/1; 160/9; 160/133

[58] Field of Search ..... 160/2, 6, 7, 9, 160/1, 133, 188, 310; 292/17 R, 12 D, 223

[56] References Cited

U.S. PATENT DOCUMENTS

| | | | |
|---|---|---|---|
| 1,515,372 | 11/1924 | Smith | 160/321 |
| 1,628,011 | 5/1927 | Tompkins | 160/2 |
| 2,564,208 | 8/1951 | Michelman | 160/7 |
| 4,147,197 | 4/1979 | Bailey et al. | 160/7 |
| 4,664,170 | 5/1987 | Labelle | 160/9 |
| 5,129,442 | 7/1992 | Warner | 160/310 |
| 5,263,527 | 11/1993 | Marlatt et al. | 160/7 |
| 5,353,859 | 10/1994 | Oltahfer et al. | 160/310 |
| 5,839,555 | 11/1998 | Hsieh | 160/310 |
| 5,893,234 | 4/1999 | McKeon | 160/7 |
| 6,055,885 | 5/2000 | Shea | 160/310 |

*Primary Examiner*—Blair M. Johnson
*Attorney, Agent, or Firm*—Snell & Wilmer L.L.P.

[57] ABSTRACT

A method and apparatus according to various aspects of the present invention is configured to automatically reset a rollable fire door curtain in the raised position. In one embodiment, a brake is coupled to a rolling fire door axle by an electromechanical clutch. The fire door is pre-disposed to unroll and close the opening, however, the brake prevents the door from unrolling. When a switch, a signal, or a fusible link indicates that the fire door should close, an electromechanical circuit board sends an electrical signal to an electromechanical clutch which opens the clutch. With the clutch open, the brake is no longer coupled to the fire door and the door closes. When the switch or signal is reversed, the clutch closes, re-coupling the fire door axle to the brake. The brake allows input rotation in both directions, but prevents the rolling door from closing under its own weight. Therefore, upon raising the curtain, the fire door is automatically reset and ready to close in the event of a fire.

28 Claims, 6 Drawing Sheets

APPARATUS AND METHOD FOR OPERATING A DOOR

BACKGROUND OF THE INVENTION

1. Field of the Invention

The invention generally relates to doors, and more particularly, to door systems which can be selectively actuated and reset to a normal operational mode.

2. Description of the Related Art

Modern building practices include a wide array of measures aimed at fire prevention and control. Besides alarm systems, buildings are commonly equipped with additional fire prevention and control measures, such as sprinkler systems and portable fire extinguishers. In addition, many structures are equipped with safety systems, including fire doors, to inhibit the spread of fire beyond a particular area. Typically, a fire door is configured to remain open until a particular triggering event, such as the presence of abnormal heat or smoke, causes the door to close. After the door closes, the fire, as well as smoke, fumes, and heat, tend to be contained on one side of the door.

For example, referring to FIG. 1, a conventional safety system in the form of a fire door system 20 is configured to prevent the spread of smoke, flames, heat, or other substances from one area to another area. In the fire door system 20, a fire and smoke resistant curtain 22 is adapted to be raised or lowered to open or close a passage, such as a hallway, door, window, or the like. The curtain 22 is guided by tracks 24 located on either side of the curtain 22 and attached at one end to a barrel 26. The barrel 26 is fixed to an axle 28 that is supported for rotational movement between a pair of end plates 30. As the axle 28 is rotated in a first direction, the curtain 22 rolls off the barrel 26 and the passage is closed. Conversely, as the axle 28 is rotated in a second direction that is opposite to the first direction, the curtain 22 rolls onto the barrel 26 and retracts inside of a hood 32 such that the passage is opened.

When the curtain 22 is rolled onto the barrel 26 in order to provide an unobstructed passage, it is normally biased by gravity to roll off the barrel 26 and close the passage. Therefore, a tension spring 34 is disposed about the axle 28 and suitably wound so as to counterbalance the tendency of the curtain 22 to fall. However, once a triggering event occurs that dictates that the curtain 22 should be lowered (e.g., a fire), the counterbalancing force provided by the tension spring 34 is released so that the curtain 22 unwinds from the barrel 26 and closes the passage.

To accomplish this releasing function, a first release device 36 is attached to a retention mechanism (not shown) which engages one end of the tension spring 34. Disengaging the retention mechanism releases the tension on the tension spring 34, and thus the counter-balancing force applied to the axle 28. In addition, a second release device 35 can be attached to the opposite end of the first release device 36. The second release device 35 is connected to one end of the first release device 36 such that the first release device 36 engages the tension spring 34 until an alarm is received or in some instances, until a power outage occurs. If an alarm is received or a power outage is encountered, the second release device 35 will release the one end of the first release device 36 such that the retention mechanism is disengaged. Alternatively, if the first release device 36 melts due to heat generated by a fire or an explosion, the retention mechanism releases one end of the tension spring 34, allowing the tension spring 34 to unwind. This allows the axle 28 to rotate such that the curtain 22 rolls off the barrel 26 and lowers to close the passage. However, if the second release device 35 receives a false alarm signal (or in some instances, an intermittent power interruption occurs), the door may inadvertently close during non-emergency periods.

Due to the important function provided by fire door systems 20, they are frequently tested to ensure that the system 20 properly functions. Testing typically includes activating the first release device 36 such that the tension spring 34 is released and the curtain 22 lowers to a closed position. After the test is completed, however, the curtain 22 is raised and the tension spring 34 readjusted to maintain the curtain 22 in the opened position. Because the tension spring 34 adjustment is crucial to the system 20 operation, a special technician usually resets the door. Therefore, maintenance of the fire door system becomes labor intensive and expensive.

SUMMARY OF THE INVENTION

A door system according to various aspects of the present invention comprises a door that may be open or closed according to the detection of a triggering event. In one embodiment, the door system includes a door which is biased towards a default position. The door system further includes an operator input system, a brake mechanism, and a clutch mechanism. When the clutch mechanism is engaged the position of the door is controlled by the operator input system. Though the door is biased towards the default position, the brake mechanism retains the door in the position selected via the operator input system.

When the clutch mechanism is disengaged, the bias of the door towards the default position allows the door to move to the default position. To reset the door to a non-default position, the clutch system is engaged and the operator input system is activated. As the door is moved to the desired position, the brake mechanism inhibits the bias on the door from returning the door to the default position until the clutch mechanism is again disengaged.

BRIEF DESCRIPTION OF THE DRAWING FIGURES

The subject matter of the invention is particularly pointed out and distinctly claimed in the concluding portion of the specification. The invention, however, both as to organization and method of operation, may best be understood by reference to the following description taken in conjunction with the claims and the accompanying drawing, in which like parts may be referred to by like numerals:

DETAILED DESCRIPTION OF A PREFERRED EXEMPLARY EMBODIMENT

The ensuing description relates to a preferred exemplary embodiment only, and is not intended to limit the scope, applicability, or configuration of the invention in any way. Instead, the ensuing description provides guidance for implementing a preferred embodiment of the invention, it being understood that various changes may be made in the function and arrangement of elements described in the preferred embodiments without departing from the spirit and scope of the invention as set forth in the appended claims.

Figure 1:
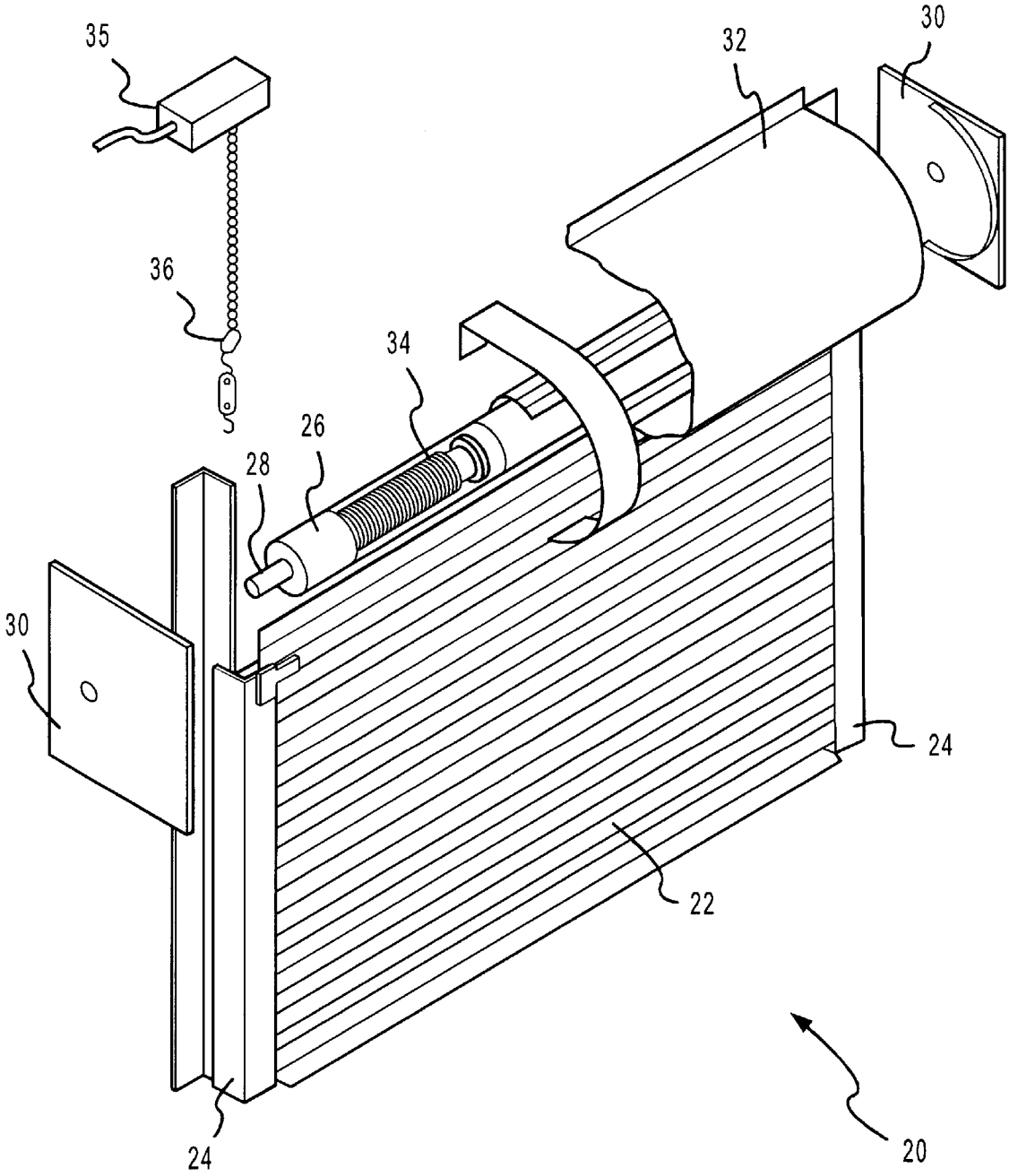
PRIOR ART FIG.1
FIG. 1 is a perspective view of a rolling fire door according to the prior art.
Figure 3:
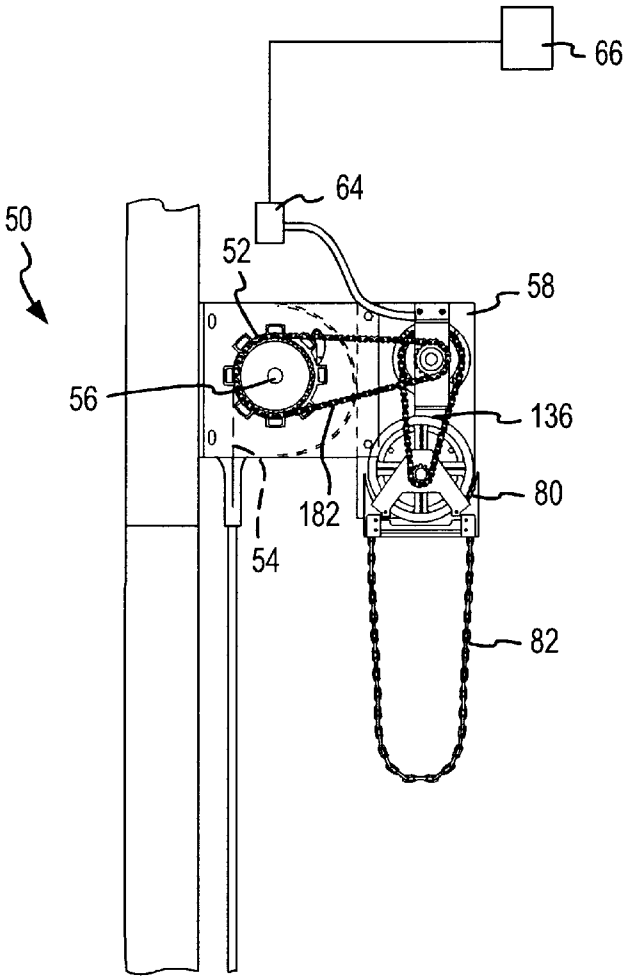
FIG. 3 is a side view of a fire door system according to a preferred embodiment of the present invention.
Figure 2:
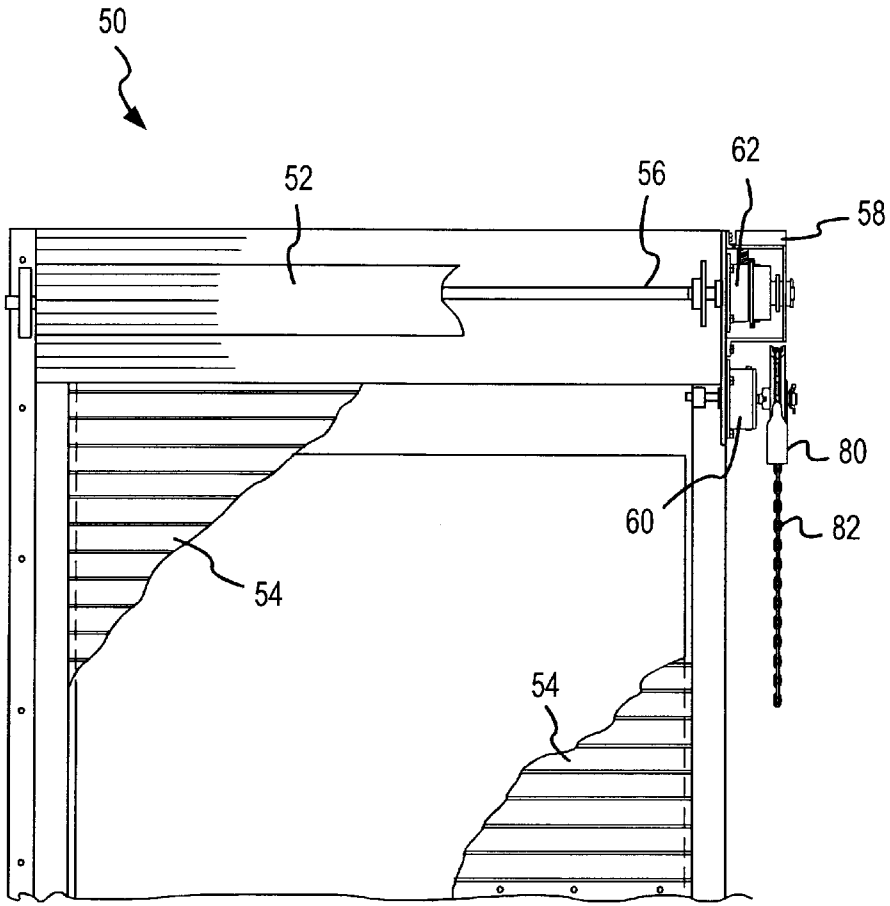
FIG. 2 is a perspective view of a fire door system according to a preferred embodiment of the present invention.

Referring now to FIGS. 2 and 3, a door system according to various aspects of the present invention comprises a safety door system, such as a fire door system 50, that tends to prevent the spread of smoke, flames, heat, noxious gases, or other substances from one area to another area. A door system according to various aspects of the invention may be configured, however, to inhibit transfer of solid, gas or liquid in any appropriate emergency and non-emergency situation. The fire door system 50 suitably includes a curtain 54; a barrel 52 adapted to receive the curtain 54; an axle 56 that is affixed to the barrel 52 and supported for rotational movement; and an operating mechanism 58 for controlling the rotational movement of the barrel 52 to control the action of the curtain 54. The curtain 54 is suitably configured to remain in a selected position until a triggering event occurs, at which time the operating mechanism 58 facilitates rotation of the axle 56 and barrel 52, causing the curtain 54 to close. The operating mechanism 58 is then suitably activated to reset the curtain 54 into the open position.

The curtain 54 comprises any suitable barrier for inhibiting the transfer of material from one area to the other area, or in some cases, inhibiting the transfer of selected materials and facilitating the transfer of others. In the present embodiment, the curtain 54 comprises a conventional curtain, for example, multiple galvanized steel slats, and may be thermally insulated to inhibit the transfer of fire, smoke, and heat past the door. In other door systems, the curtain 54 may comprise another type of door or curtain altogether, such as a weather resistant door, a service door, a hurricane door, or a security grill. Similarly, the door may be configured to operate in another manner, such as a side-opening door, a non-rolling overhead door, a sliding door, or any other suitable type or configuration of door.

The curtain 54 is suitably attached at its top end to the barrel 52. The barrel 52 supports the top end of the curtain 54 when the curtain 54 is lowered and supports the rolled-up curtain 54 when it is raised. The barrel 52 suitably comprises a cylinder comprising a rigid, nonflammable material of sufficient strength to support the curtain 54. For example, the barrel 52 suitably comprises a steel tube having a hollow interior for receiving the axle 56.

The axle 56 supports the curtain 54 and the barrel 52 and suitably transfers torque from the operating mechanism 58 to the barrel 52. The axle 56 may be comprised of a rigid, nonflammable material of sufficient strength to support the curtain 54 and the barrel 52. In the present embodiment, the axle 56 comprises a steel rod having a first end rotatably supported by an end plate and a second end connected to the operating mechanism 58. The axle 56 is also suitably connected to a damper 57, in any conventional manner, such as a rotational damper comprising a conventional viscous fluid damping pot or a conventional ratcheting escapement system, for controlling the speed at which the axle 56 rotates and/or the curtain 54 descends.

The operating mechanism 58 controls the opening and closing of the curtain 54. In response to a triggering event, the operating mechanism 58 automatically initiates closing of the curtain 54. In addition, the operating mechanism 58 controls operation of the door system 50, for example resetting the door system 50 to the open position, when a triggering event is not occurring.

In the present embodiment, the operating mechanism 58 comprises an operator input system, such as a chain operator 80, for controlling the door system 50 when a triggering event is not occurring; a clutch mechanism 62 for coupling or decoupling the axle 56 and the chain operator 80; and a brake mechanism 60 that inhibits the transfer of torque from the clutch mechanism 62 to the chain operator 80 and facilitates the transfer of torque from the chain operator 80 to the clutch mechanism 62. The brake mechanism 60 and clutch mechanism 62 are configured to control the axle 56 such that the curtain 54 is maintained in a selected position until a triggering event occurs, at which time the curtain 54 moves to its default position, i.e. is closing.

Figure 4:
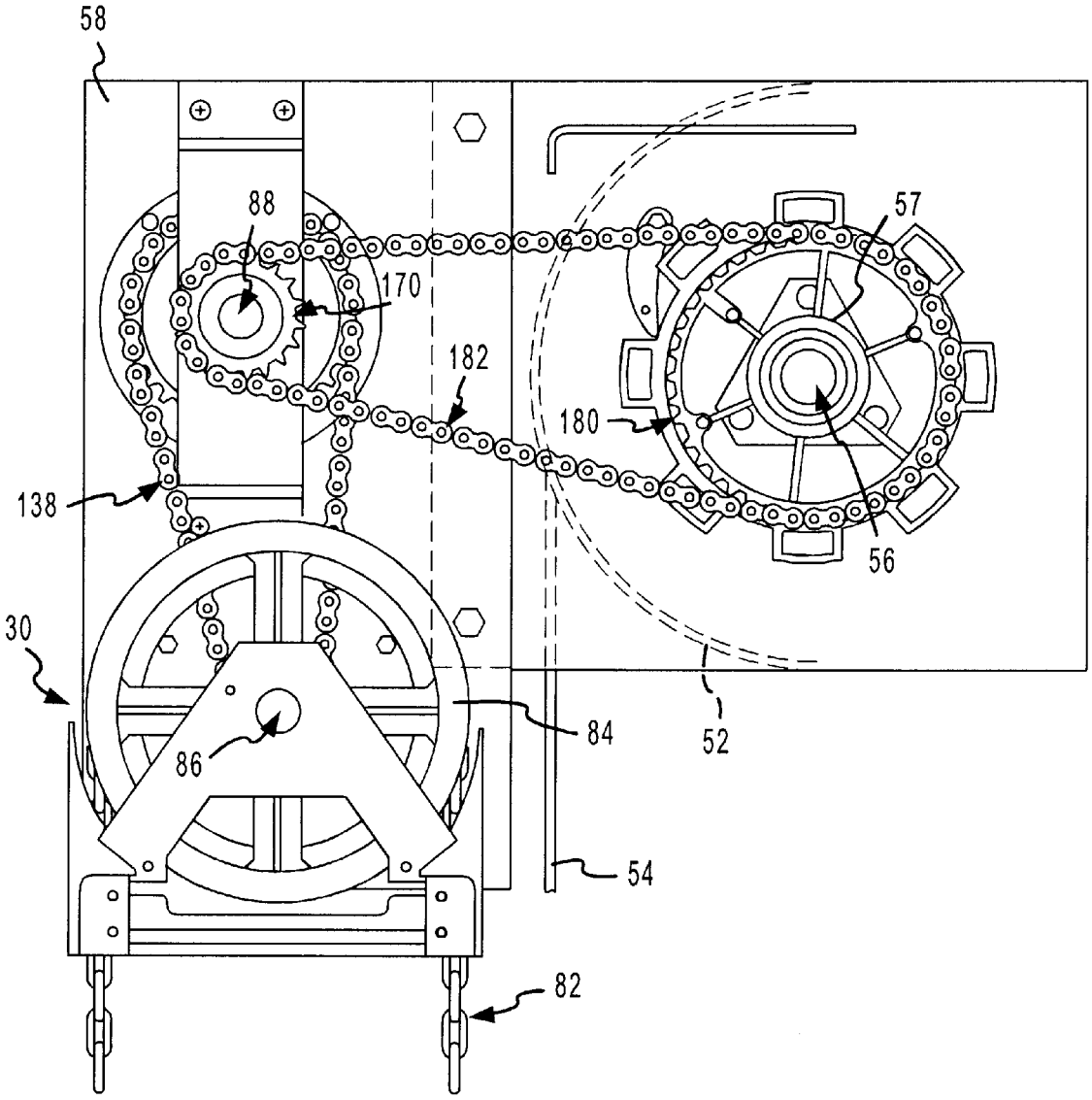
FIG. 4 is an enlarge perspective view of the operating mechanism according to a preferred embodiment of the present invention.
Figure 5:
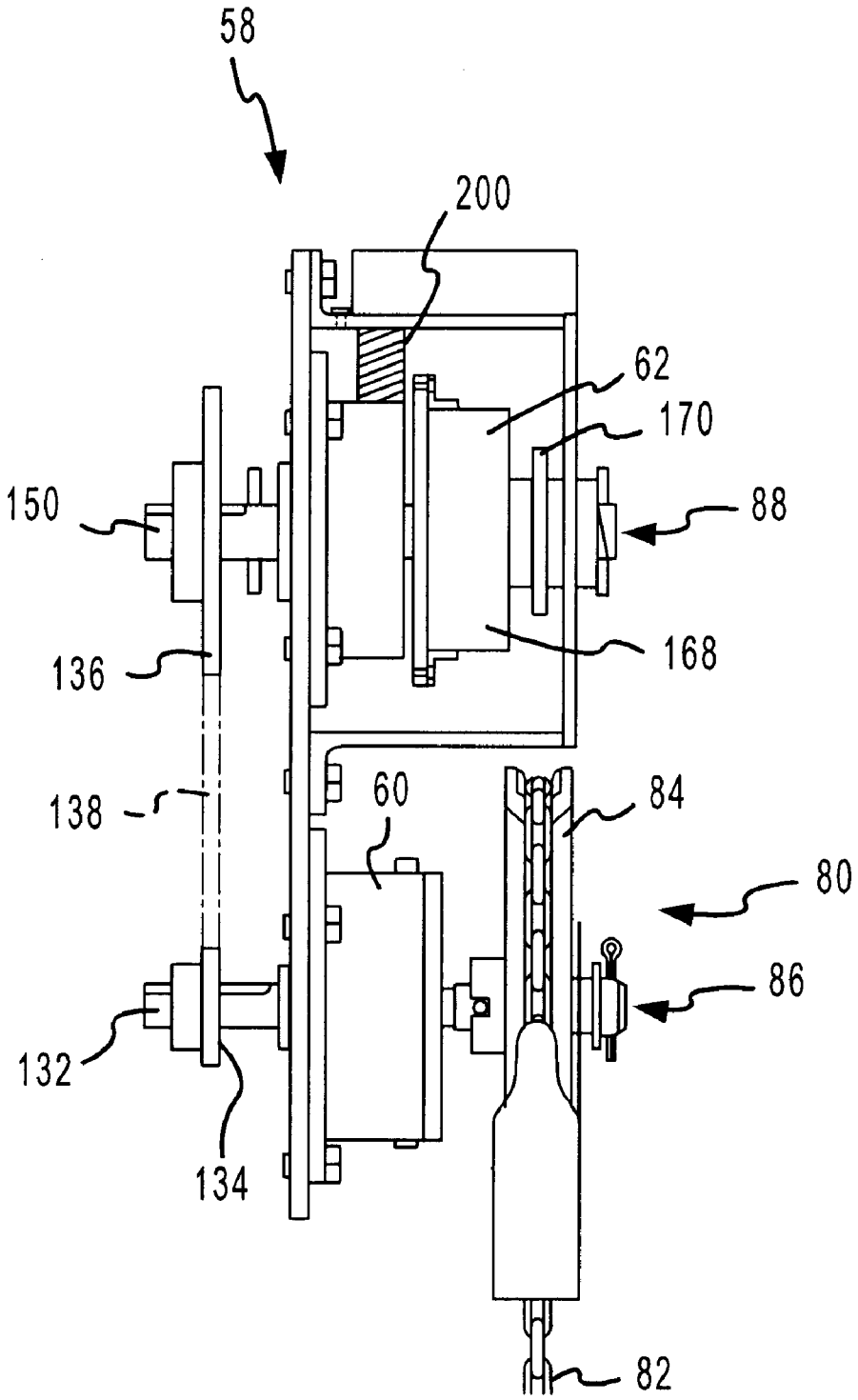
FIG. 5 is an enlarged side view of the operating mechanism according to a preferred embodiment of the present invention.

Referring now to FIGS. 4 and 5, the chain operator 80 facilitates moving the curtain 54 from a closed position to an opened position. The chain operator 80 includes an operator input and a torque transfer mechanism. The operator input may comprise any appropriate mechanism for operating the curtain 54, such as a mechanism for applying force to the axle 56 to raise the curtain 54. In the present embodiment, the operator input suitably comprises an operator chain 82 which applies torque to the torque transfer mechanism. The operator chain 82 may be driven in any suitable manner, including manually or by a motor.

The torque transfer mechanism receives torque from the operator input and transfers the torque to the axle 56, suitably via other components of the chain operator 80. Any suitable mechanism may be implemented as the torque transfer mechanism, such as a gear system, a pulley system, or a straight mechanical connection. In the present embodiment, the torque transfer mechanism comprises a hand chain wheel 84. The hand chain wheel 84 is configured to receive and engage the operator chain 82, and as the operator chain 82 is manually or mechanically driven, the hand chain wheel 84 rotates.

The hand chain wheel 84 is rigidly connected to a hand chain wheel shaft 86 such that rotation of the hand chain wheel 84 rotates the hand chain wheel shaft 86 as well. The hand chain wheel shaft 86 is suitably connected to the brake mechanism 60. In the present embodiment, rotation of the hand chain wheel shaft 86 is transferred to the brake mechanism 60. The brake mechanism 60 suitably comprises any mechanism that prevents transfer of torque in the lowering direction, and suitably either direction, for example from the weight of the curtain 54, to the chain operator 80. Conversely, the brake mechanism 60 preferably facilitates the transfer of torque in the raising direction, and suitably either direction, from the chain operator 80 to the axle 56.

Figure 6:
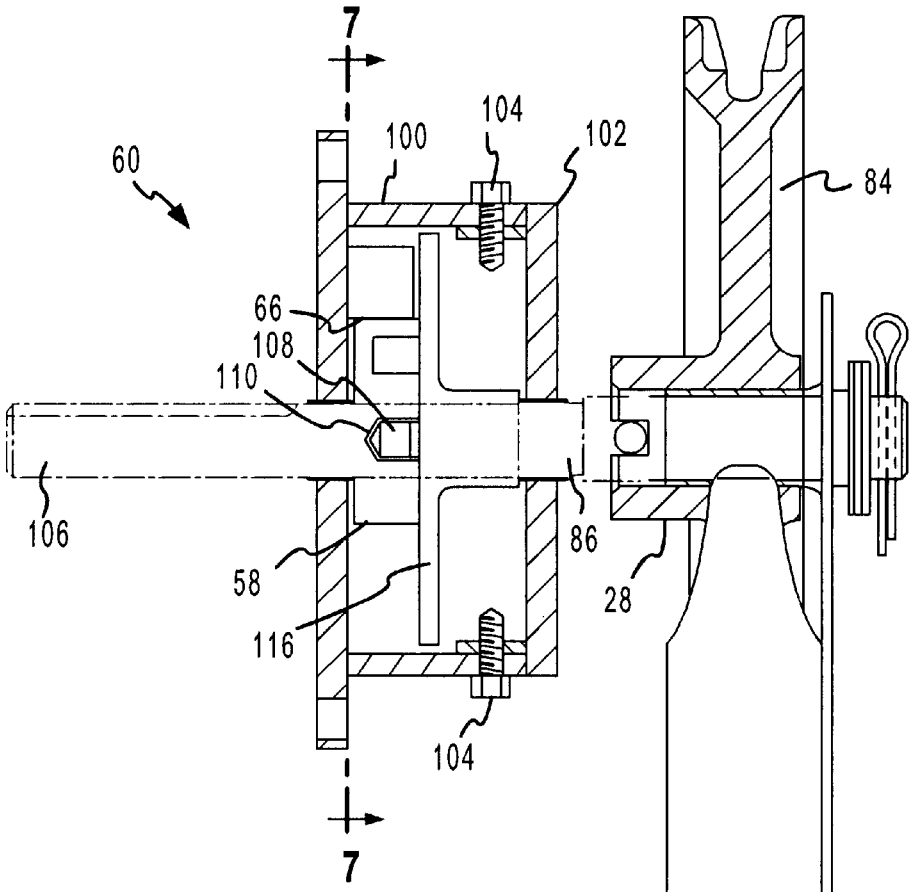
FIG. 6 is an enlarged perspective view of the brake mechanism according to a preferred embodiment of the present invention.
Figure 7:
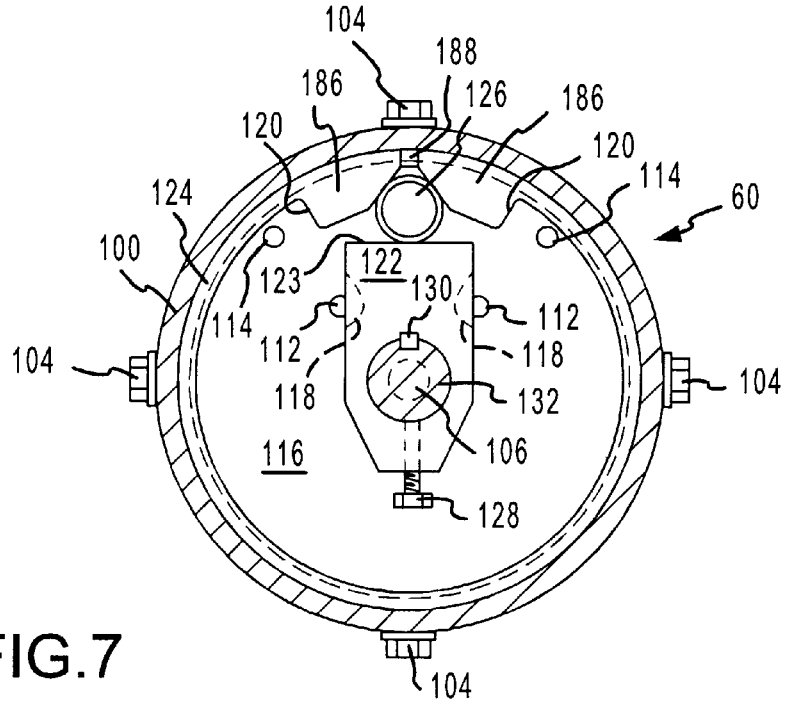
FIG. 7 is a cross sectional side view of the brake mechanism according to a preferred embodiment of the present invention taken along lines 7—7 of FIG. 6.

Referring now to FIGS. 6 and 7, the brake mechanism 60 of the present embodiment comprises a brake housing 100; an output shaft 106; a first drive pin set 112 and a second drive pin set 114; a cam 122; a roller 126; a brake drive plate 116; and a brake ring 124. The brake mechanism 60 is enclosed by a brake housing 100 which has a brake housing cover 101 suitably attached to the brake housing 100 by bolts 104. The hand chain wheel shaft 86 is suitably rigidly connected to the brake drive plate 116 such that torque applied to the hand chain wheel shaft 86 is transferred to the brake drive plate 116. The first drive pin set 112 and the second drive pin set 114 are rigidly attached to the brake drive plate 116 as well.

A brake output shaft 106 is co-axially aligned with hand chain wheel shaft 86 and mated thereto utilizing a necked-down guide portion 108 of the hand chain wheel shaft 86 which is rotatably received within a complementary cavity 110 formed within an end of the brake output shaft 106. This suitably permits a measure of relative rotary motion between the brake output shaft 106 and hand chain wheel shaft 86 within the limits defined by the brake assembly. The brake output shaft is also suitably rigidly connected to the cam 122, for example by a set screw 128 and key 130, such that rotation of cam 122 causes the brake output shaft 106 to rotate, and vice versa.

With continued reference to FIGS. 6 and 7, rotation of the hand chain wheel shaft 86 causes the first drive pin set 112 and the second drive pin set 114 of the brake drive plate 116 to rotate together. In this configuration, rotation of the hand chain wheel shaft 86 in either direction causes the first drive pin set 112 and second drive pin set 114 to engage a drive pocket set 118 of the cam 122 and drive shoulders 120 of the brake ring 124, respectively. As a result, the cam 122 and brake ring 124 rotate together. In addition, as the cam 122 rotates with brake ring 124, a roller 126 is carried between the cam 122 and the brake ring 124. Therefore, torque from the chain operator 80 applies torque to the brake drive plate 116. Rotation of the brake drive plate 116 engages causes rotation of the cam 122, which causes brake output shaft 106 to rotate.

Torque applied to the brake mechanism 60 from the brake output shaft 106, however, is not transferred to the hand chain wheel shaft 86. When torque is applied to the brake output shaft 106, the cam 122 also rotates, but the brake ring 124 is not engaged by the first or second drive pins 112, 114. Therefore, the cam 122 and brake ring 124 do not rotate together. Instead, the cam surface 123 engages the roller 126 and drives the roller 126 up one of shoulders 186, causing a brake gap 188 formed in the brake ring 124 to widen. The widening of brake gap 188 causes the brake ring 124 to frictionally contact the brake housing 100, which inhibits further rotation. Therefore, as the curtain 54 tends to roll off the barrel 52, the axle 56 rotates, thereby causing both the clutch output shaft 88 and the brake output shaft 106 to rotate. The curtain 54 is inhibited from rolling off the axle under its own weight, however, because the brake mechanism 60 inhibits rotation of the axle 56 in the direction that allows the curtain 54 to roll off the barrel 52.

The clutch mechanism 62 selectively engages and disengages the axle 56 from the brake mechanism 60 and the chain operator 80. For example, the clutch mechanism 62 suitably engages the axle 56 to the brake mechanism 60 and the chain operator 80 at any time other than a triggering event. When a triggering event occurs, however, the clutch mechanism 62 suitably disengages the axle 56 from the brake mechanism 60, allowing the axle to rotate and allow the curtain 54 to descend.

Figure 8:
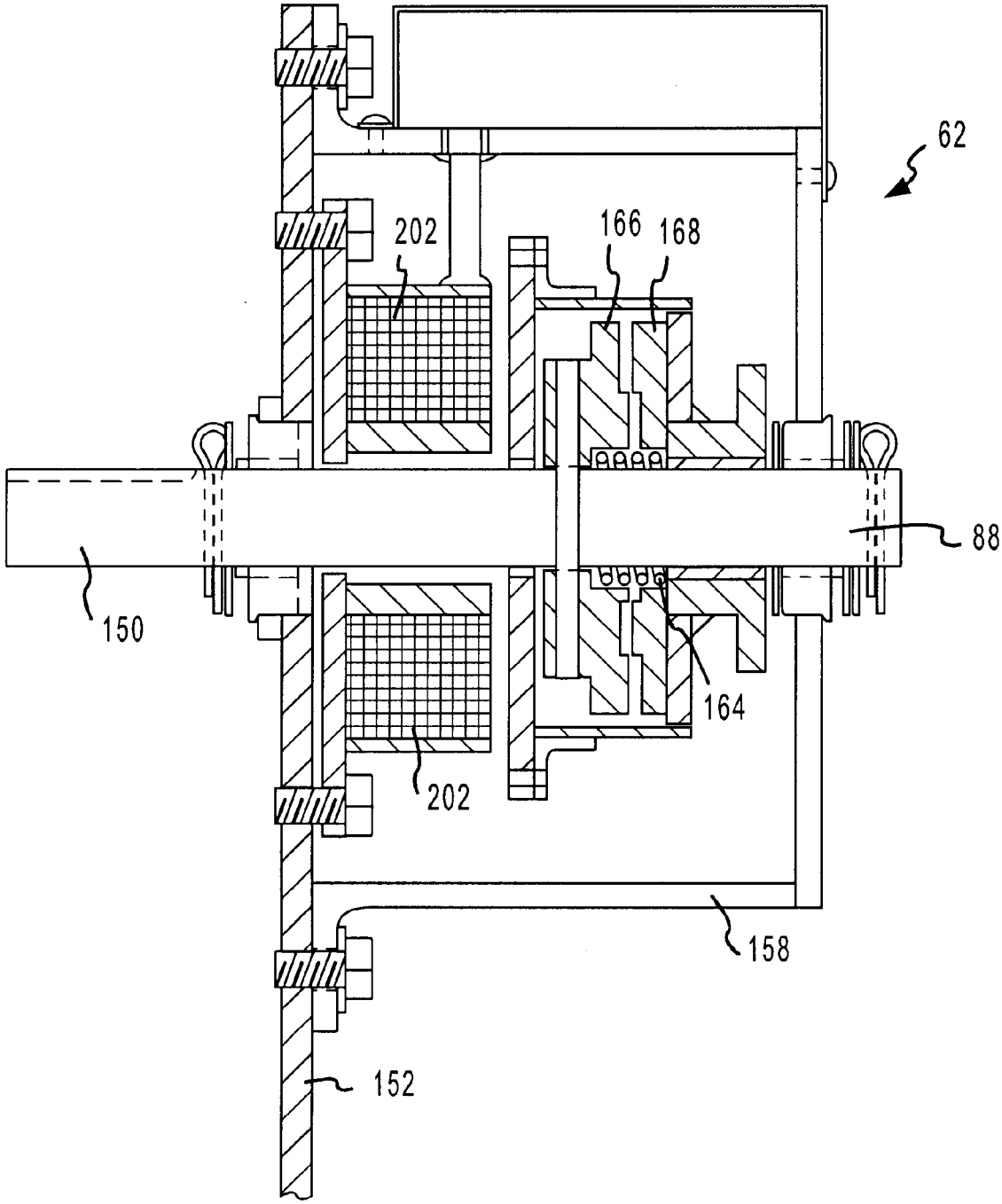
FIG. 8 is an enlarged view of the clutch mechanism according to a preferred embodiment of the present invention.

Referring now to FIG. 8, the clutch mechanism 62 suitably comprises a clutch drive shaft 150; a clutch output shaft 88; a clutch spring 164; a drive clutch assembly 166; a sprocket clutch assembly 168; and an energizing coil 202. The clutch mechanism 62 is suitably attached to a structural support 152 comprising a shaft brace 158. The clutch drive shaft 150 is connected to the brake mechanism such that rotation of the brake output shaft induces rotation of the clutch drive shaft 150. For example and referring to FIG. 5, a clutch drive sprocket 136 is suitably fixed around the clutch drive shaft 150, which thus rotates with the clutch drive sprocket 136. Rotation of the brake output shaft 132 suitably causes a brake output sprocket 134, which is suitably fixedly disposed around brake output shaft 132, to rotate. The brake output sprocket 134 is suitably connected to the clutch drive sprocket 136 by an intermediate drive chain 138 such that rotation of either the brake drive sprocket 134 or clutch drive sprocket 136 causes the other sprocket to rotate.

In the present embodiment, the clutch output shaft 88 is mated to the clutch drive shaft 150. In a preferred embodiment, the clutch output shaft 88 and the clutch drive shaft 150 are integrated into a single component. Referring to FIG. 8, the drive clutch assembly 166 is suitably fixed to the clutch drive shaft 150 such that rotation of the clutch drive shaft 150 causes the drive clutch assembly 166 to rotate. Further, the sprocket clutch assembly 168 may slide along the longitudinal axis of the clutch drive shaft 150 to facilitate the engagement and disengagement of the sprocket clutch assembly 168 to and from the drive clutch assembly 166.

The sprocket clutch assembly 168 is slidably fixed to the clutch drive shaft 150 such that the sprocket clutch assembly 168 is free to rotate and slide longitudinally about the clutch output shaft 88. The sprocket clutch assembly 168 is suitably connected to the axle 56 such that torque applied to the sprocket clutch assembly 168 is transferred to the axle 56. For example, with reference to FIGS. 4 and 5, the sprocket clutch assembly 168 is suitably fixedly attached to a clutch drive sprocket 170, and the clutch drive sprocket 170 engages a curtain sprocket 180 through a curtain drive chain 182. Thus, movement of the sprocket clutch assembly 168 drives the curtain sprocket 180. Therefore, as the curtain sprocket 180 is fixedly attached to axle 56 and the barrel 52 upon which the curtain 54 is disposed (see FIG. 2), an input force from chain operator 80 causes rotation of hand chain wheel shaft 86, which by brake mechanism 60 causes the rotation of brake output shaft 132, which by intermediate drive chain 138 causes the rotation of clutch drive shaft 150, which by clutch mechanism 62 causes the rotation of sprocket clutch assembly 168, which by curtain drive chain 182 causes the rotation of axle 56 and barrel 52, thus rolling up or down the curtain 54. However, without the brake mechanism 60, the curtain 54 would be disposed to roll back down.

Referring back to FIG. 8, the clutch spring 164 suitably biases the sprocket clutch assembly 168 away from the drive clutch assembly 166. For example, the clutch spring 164 may be disposed about the clutch drive shaft 150 and pre-loaded such that sprocket clutch assembly 168 is pressed with sufficient force to separate the sprocket clutch assembly 168 and drive clutch assembly 166 such that the sprocket clutch assembly 168 is free to rotate about the clutch drive shaft 150.

The energizing coil 202 is suitably configured to attract the sprocket clutch assembly 168 to the drive clutch assembly 166 with sufficient force to exceed that applied to the sprocket clutch assembly 168 by the clutch spring 164. Thus, when the energizing coil 202 is activated, the sprocket clutch assembly 166 is attracted to the drive clutch assembly 168, effectively engaging the clutch mechanism 62. Alternatively, a mechanical latch or suitable device may be utilized to engage or disengage the clutch as required. Irrespective, as a result, the weight of the curtain 54 is held by the brake mechanism 60. However, once a current is no longer provided to the energizing coil 202, the clutch spring 164 returns the clutch mechanism 62 to a declutching mode so that the brake mechanism is not engaged to the axle. Therefore, the weight of the curtain 54 causes the door to close. Once the current is restored to the energizing coil 202, the clutch mechanism returns to a clutching mode so that the brake mechanism is engaged to the axle and the door is inhibited from closing via gravity. In this manner, the clutch is automatically reset and fire door can be raised via the chain operator 80.

Current applied to the energizing coil 202 may be controlled by any appropriate controlling mechanism. In the present embodiment, the energizing coil is controlled by an external triggering system 66 (see FIG. 3). The triggering system suitably provides an energizing current where upon detection of a triggering event, the triggering system ceases the energizing current. The triggering system 66 may assert the signal in response to any appropriate triggering event, such as detection of fire, heat, or smoke, or other substance, initiation of a test of the operation the fire door system 50, or securing of an area. Detection of the triggering event may be performed in any suitable manner, such as in conjunction with a fusible link, a smoke or heat alarm of any number of conditions, or the activation of a switch. The triggering system 66 suitably generates a signal, such as an electrical, optic, acoustic, RF, mechanical, hydraulic, or other suitable signal, to indicate a triggering event. In the present embodiment, the triggering system 66 controls the current which is applied to the energizing coil 202, for example via a set of wires 200 (FIG. 5).

Typically, the curtain 54 remains in the raised position until a triggering event. The weight of the curtain 54 applies a torque to the axle 56 in the closing direction. The clutch mechanism 62 remains in the clutching mode so that torque applied by the axle is transferred by the clutch mechanism to the brake output shaft 106. The brake mechanism 60, however, does not transfer torque from the brake output shaft 106 to the chain operator 80. Consequently, rotation of the brake output shaft 106 is inhibited, and the curtain 54 remains in the open and raised position.

When a triggering event occurs, the triggering system 66 generates a signal which places the clutch mechanism 62 in the declutching mode. As a result, the clutch operating shaft 88 and the axle 56 disengage from the clutch input shaft 150, and there fore the brake mechanism 60 as well. The axle 56 then rotates under the weight of the curtain 54, allowing the curtain 54 to descend.

When the triggering event ends, the clutch mechanism 62 returns to the clutching mode. To reset the curtain 54 to the raised position, the operator chain 82 is driven to rotate the hand chain wheel 84. Rotation of the hand chain wheel 84 is transferred by the brake mechanism 60, causing the brake output shaft 106 to rotate. Rotation of the brake output shaft 106 induces rotation of the clutch drive shaft 150. Because the clutch mechanism 62 is engaged, rotation of the clutch dive shaft 150 is transferred to the clutch drive sprocket 170, which rotates the axle 56. Therefore, rotation of the hand chain wheel 84 causes rotation of the axle 56, facilitating the raising of the curtain 54. When the curtain 54 rises to a selected position, such as a fully opened position, the chain operator 80 may be released. The brake mechanism 60 inhibits the transfer of torque from the axle 56 back to the chain operator 80, thus retaining the curtain 54 in a selected position.

In view of the foregoing, it can be appreciated that a safety door system is provided that may be operated and tested with ease and little expense. Furthermore, while the principles of the invention have now been made clear in illustrative embodiments, many modifications of structure, arrangements, proportions, the elements, materials and components, used in the practice of the invention, which are particularly adapted for a specific environment and operating requirements, may be made without departing from those principles.

What is claimed is:

1. An apparatus connected to a door for shifting the door between a first position and a second position in response to an input signal, comprising:

the door being mounted on an axle;

a transfer system attached to the door and configured to move the door between the first position and the second position; and an operating mechanism, including:

a brake selectively engaged with said transfer system and operatively configured to inhibit movement of the door from the first position to the second position, wherein said brake engages a chain operator which drives said axle to the first position and the second position, wherein said brake facilitates transfer of torque from the chain operator to the axle but not from the axle to the chain operator; and a clutch operable in a clutching mode and a declutching mode, said clutching mode engaging said brake to said axle and said declutching mode disengaging said brake from said axle, said clutch transferring from said clutching mode to said declutching mode in response to the input signal.

2. The apparatus of claim 1, wherein said transfer system includes a damper configured to regulate the rate at which the door moves.

3. The apparatus of claim 1, wherein said chain operator comprises a torque transfer mechanism and an operator input, said torque transfer mechanism transferring torque generated by said operator input to the transfer system.

4. The apparatus of claim 1, wherein said clutch is configured to automatically return to said clutching mode upon cessation of said input signal.

5. The apparatus of claim 1, wherein said clutch comprises a clutch drive shaft connected to said brake such that rotation of a brake output shaft of said brake induces rotation of said clutch drive shaft.

6. The apparatus of claim 5, wherein said clutch further comprises a drive clutch assembly fixed to said clutch drive shaft such that rotation of said clutch drive shaft causes said drive clutch assembly to rotate.

7. The apparatus of claim 6, wherein said clutch further comprises a sprocket clutch assembly connected to the transfer system and slidably fixed to said clutch drive shaft such that said sprocket clutch assembly is free to rotate about said clutch output shaft.

8. The apparatus of claim 7, wherein said clutch further comprises a clutch spring disposed about said clutch drive shaft and interposed between said drive clutch assembly and said sprocket clutch assembly such that a force is presented to separate said drive clutch assembly from said sprocket clutch assembly and said sprocket clutch assembly is free to rotate about said clutch drive shaft.

9. The apparatus of claim 8, wherein said clutch further comprises an energizing coil configured to attract said sprocket clutch assembly to said drive clutch assembly with sufficient force to exceed said force presented by said clutch spring, thereby transferring said clutch from said declutching mode to said clutching mode.

10. The apparatus of claim 1, wherein said door is a fire curtain.

11. An apparatus connected to a door for operating the door which is mounted on an axle supported for movement of the door in response to an input signal such that the door is moved toward a first position when the axle rotates in a first direction and moved toward a second position when the axle rotates in a second direction, wherein the door is biased to move in the second direction, comprising:

a brake mechanism selectably engageable with said axle, wherein said brake mechanism inhibits rotational movement of said axle in the second direction in response to the bias of the door in the second direction, wherein said brake mechanism engages a chain operator for driving the axle to said first position and said second position, wherein said brake facilitates transfer of torque from the chain operator to the axle but not from the axle to the chain operator; and a clutch mechanism coupled to said brake mechanism and the door, said clutch mechanism being selectably operable in a first mode and a second mode, said first mode engaging said brake mechanism to said axle and said second mode disengaging said brake mechanism from said axle, said clutch mechanism transferring between said first mode and said second mode in response to the input signal.

12. The apparatus of claim 11, further comprising an operator input system coupled to at least one of the axle, said brake mechanism, and said clutch mechanism for selectably driving the axle in said first direction and said second direction.

13. The apparatus of claim 12, wherein said operator input system comprises:

an operator input for applying torque; and a torque transfer mechanism coupled to said operator input, wherein said torque transfer mechanism is coupled to said at least one of the axle, said brake mechanism, and said clutch mechanism for transferring said torque from said operator input to said at least one of the axle, said brake mechanism, and said clutch mechanism.

14. The apparatus of claim 11, further comprising a damper connected to said axle, said damper regulating the rate at which said axle rotates.

15. The apparatus of claim 11, wherein said brake mechanism includes a brake output shaft, and said clutch mechanism includes:

a clutch drive shaft coupled to said brake output shaft such that rotation of said brake output shaft induces rotation of said clutch drive shaft;

a drive clutch assembly fixed to said clutch drive shaft such that rotation of said clutch drive shaft causes said drive clutch assembly to rotate; and a sprocket clutch assembly coupled to the door, wherein said sprocket clutch assembly is slidably fixed to said clutch drive shaft such that said sprocket clutch assembly selectably moves longitudinally along said clutch output shaft in response to the input signal.

16. The apparatus of claim 15, wherein said clutch mechanism further comprises a clutch spring disposed about said clutch drive shaft and interposed between said drive clutch assembly and said sprocket clutch assembly.

17. The apparatus of claim 16, wherein said clutch mechanism further comprises an energizing coil configured to attract selectably counter a force of the spring in response to the input signal.

18. The apparatus of claim 11, wherein the door comprises a fire curtain.

19. A method for operating a rollable door between a first position and a second position in response to an input signal, comprising the step of:

supporting the door for rotational movement such that the rollable door is moved toward the first position by rotating in a first direction and moved toward the second position by rotating in a second direction;

selectively engaging the door to a brake mechanism that is operatively configured to inhibit movement of the door in said second direction;

configuring a clutch mechanism to operate in a clutching mode and a declutching mode, said clutching mode engaging said brake mechanism to the door and said declutching mode disengaging said brake mechanism from the door;

connecting a clutch drive shaft of said clutch mechanism to said brake mechanism such that rotation of a brake output shaft of said brake mechanism induces rotation of said clutch drive shaft; and transferring said clutch mechanism from said clutching mode to said declutching mode in response to the input signal.

20. The method of claim 19, further comprising the step of returning said clutch mechanism to said clutching mode upon cessation of said input signal.

21. The method of claim 19, further comprising the step of moving the door to the first position with a chain operator.

22. The method of claim 21, wherein the chain operator is configured to selectively disable the brake mechanism.

23. The method of claim 19, further comprising the step of transferring torque generated by an operator to the door with a torque transfer mechanism.

24. The method of claim 19, further comprising the step of regulating the rate at which said axle rotates with a damper connected to said axle.

25. The method of claim 19, further comprising the step of fixing a drive clutch assembly to said clutch drive shaft such that rotation of said clutch drive shaft causes said drive clutch assembly to rotate.

26. The method of claim 25, further comprising the steps of:

connecting a sprocket clutch assembly to the door with said clutch output shaft; and configuring said sprocket clutch assembly to be slidably fixed to said clutch drive shaft such that said sprocket clutch assembly is free to rotate about said clutch output shaft.

27. The method of claim 26, further comprising the step of interposing a clutch spring between said drive clutch assembly and said sprocket clutch assembly such that a force is presented to separate said drive clutch assembly from said sprocket clutch assembly.

28. The method of claim 27, further comprising the step of configuring an energizing coil to attract said sprocket clutch assembly to said drive clutch assembly with sufficient force to exceed said force presented by said clutch spring, thereby transferring said clutch mechanism from said declutching mode to said clutching mode.

* * * * *